US006952011B2

(12) United States Patent
Brown et al.

(10) Patent No.: US 6,952,011 B2
(45) Date of Patent: Oct. 4, 2005

(54) MALDI SAMPLE PLATE

(75) Inventors: Jeff Brown, Cheshire (GB); Dominic Gostick, Cheshire (GB); Edouard S. P. Bouvier, Stow, MA (US); John Charles Gebler, Hopkinton, MA (US); Peter Jeng Jong Lee, Westborough, MA (US); James Ian Langridge, Cheshire (GB); Emmanuelle Claude, Altrincham (GB); Weibin Chen, Holliston, MA (US)

(73) Assignee: Micromass UK Limited, Manchester (GB)

( * ) Notice: Subject to any disclaimer, the term of this patent is extended or adjusted under 35 U.S.C. 154(b) by 0 days.

(21) Appl. No.: 10/223,401

(22) Filed: Aug. 19, 2002

(65) Prior Publication Data

US 2003/0116707 A1 Jun. 26, 2003

(30) Foreign Application Priority Data

Aug. 17, 2001 (GB) ..... 0120131

(51) Int. Cl.[7] ..... H01J 49/04
(52) U.S. Cl. ..... 250/288; 435/23
(58) Field of Search ..... 250/288; 435/6

(56) References Cited

U.S. PATENT DOCUMENTS

| | | | | |
|---|---|---|---|---|
| 5,828,063 A | | 10/1998 | Koster et al. | 250/288 |
| 5,859,431 A | * | 1/1999 | Cotrell et al. | 250/288 |
| 5,894,063 A | | 4/1999 | Hutchens et al. | 436/155 |
| 6,004,770 A | | 12/1999 | Nelson | 435/23 |
| 6,225,047 B1 | | 5/2001 | Hutchens et al. | 435/5 |
| 6,265,715 B1 | | 7/2001 | Perreault et al. | 250/288 |
| 6,287,872 B1 | | 9/2001 | Schurenberg et al. | 436/181 |
| 6,376,044 B1 | | 4/2002 | Jarrell et al. | 428/141 |
| 6,539,102 B1 | * | 3/2003 | Anderson et al. | 382/128 |
| 6,555,813 B1 | * | 4/2003 | Beecher et al. | 250/281 |
| 6,580,070 B2 | | 6/2003 | Cornish et al. | 250/287 |
| 2002/0051738 A1 | | 5/2002 | Schurenberg et al. | 422/102 |
| 2002/0068133 A1 | | 6/2002 | Jarrell et al. | 427/596 |
| 2002/0094533 A1 | * | 7/2002 | Hess et al. | 435/6 |
| 2002/0121595 A1 | | 9/2002 | Sunner et al. | 250/281 |
| 2002/0150903 A1 | | 10/2002 | Koster | 435/6 |
| 2003/0010908 A1 | | 1/2003 | Clark et al. | 250/288 |
| 2003/0057368 A1 | | 3/2003 | Franzen et al. | 250/281 |

FOREIGN PATENT DOCUMENTS

| | | |
|---|---|---|
| DE | 19618032 A1 | 11/1997 |
| DE | 10043042 A1 | 3/2002 |
| EP | 1274116 A2 | 1/2003 |
| GB | 2312782 A | 11/1997 |
| GB | 2332273 A | 6/1999 |

(Continued)

OTHER PUBLICATIONS

Adam H. Brockman et al.; *A Desalting Approach for MALDI–MS Using On–Probe Hydrophobic–Self–Assembled Monolayers*, Analytical Chemistry, vol. 69, No. 22, Nov. 15, 1997. pp. 4716–4720, 6 Figs.

(Continued)

*Primary Examiner*—John R. Lee
*Assistant Examiner*—Phillip A Johnston
(74) *Attorney, Agent, or Firm*—Madan, Mossman & Sriram, P.C.

(57) ABSTRACT

A MALDI sample plate 1 is disclosed which comprises a metallic substrate 2 having a circular groove or moat 3. A hydrophobic polytetrafluoroethylene layer 4 is applied to the substrate 2 and a central portion 5 of the substrate 2 is laser etched which roughens the surface of the substrate 2. A thin polystyrene layer is then applied to the polytetrafluoroethylene layer 4 and the central portion 5.

35 Claims, 7 Drawing Sheets

FOREIGN PATENT DOCUMENTS

| | | | |
|---|---|---|---|
| GB | 2370114 | A | 6/2002 |
| JP | 2001013110 | | 1/2001 |
| WO | WO93/00700 | | 1/1993 |
| WO | WO99/34920 | | 7/1999 |
| WO | WO00/66265 | | 11/2000 |
| WO | WO00/67293 | A1 | 11/2000 |
| WO | WO00/77812 | A2 | 12/2000 |
| WO | WO01/19520 | A1 | 3/2001 |
| WO | WO02/30561 | A2 | 4/2002 |
| WO | WO02/089982 | A2 | 11/2002 |
| WO | WO02/093170 | A1 | 11/2002 |
| WO | WO02/097392 | A2 | 12/2002 |

OTHER PUBLICATIONS

Maggie Merchant et al.; *Recent advancements in surface–enhanced laser desorption/ionization–time of flight–mass spectrometry*, Electrophoresis 2000, 21, pp. 1164–1177, 14 Figs.

Martin Gilar et al.; *Advances in sample preparation in electromigration, chromatographic and mass spectrometric separation methods*, Journal of Chromatography A, 909, (2001), pp. 111–135, 4 Figs.

Johan Gobom et al.; *α–Cyano–4–hydroxycinnamic Acid Affinity Sample Preparation . . . A Protocol for MALDI–MS Peptide Analysis in Proteomics*, Analytical Chemistry, vol. 73, No. 3, Feb. 1, 2001, pp. 434–438, 6 Figs.

Simon Ekstrom et al.; *Signal Amplification Using "Spot–on–a–Chip" Technology for the Identification of Proteins via MALDI–TOF MS*, Analytical Chemistry, vol. 73, No. 2, Jan. 15, 2001, pp. 214–219, 7 Figs.

Igor P. Smirnov et al.; *Application of DNA–binding polymers for preparation of DNA for analysis by matrix–assisted laser desorption/ionization mass spectrometry*, Rapid Commun. Mass Spectrom. 2001; 15: pp. 1427–1432 5 Figs.

Victor V. Laiko et al.; *Atmospheric pressure laser desorption/ionization on porous silicon*, Rapid COmmun. Mass Spectrom. 2002, 16: pp. 1737–1742, 5 Figs.

Tasso Miliotis et al.; *Ready–made matrix–assisted laser desorption/ionization target plates coated with thin matrix layer for automated sample deposition in high–density array format*, Rapid Commun. Mass Spectrom, 2002; 16: pp. 117–126, 9 Figs.

Mark E. McComb et al.; *Use of a Non–porous Polyurethane Membrane as a Sample Support for Matrix–assisted Laser Desorption/Ionization Time–of–flight Mass Spectrometry of Peptides and Proteins*, Rapid Communications in Mass Spectrometry, 1997, vol. 11, pp. 1716–1722, 10 Figs.

Li Zhang et al.; *Solid–Phase Extraction/MALDI–MS: Extended Ion–Pairing Surfaces for the On–Target Cleanup of Protein Samples*, Analytical Chemistry, vol. 71, 1999, pp. 4753–4757, 5 Figs.

T. William Hutchens et al.;*Surface–Enhanced Laser Desorption/Ionization (SELDI): Probe Surfaces Enhanced for Affinity Capture (SEAC) Energy Absorbing Molecules (EAM) for Neat Desorption (SEND) of Intact Biopolymers*, Microbeam Anal. Soc, 29th, (1995), pp. 41–42, 1 Fig.

Adam H. Brockman et al.; *Optimization of a Hydrophobic Solid–phase Extraction Interface for Matrix–Assisted Laser Desorption/Ionization*, Journal of Mass Spectrometry, 33, (1998), pp. 1141–1147, 3 Figs., 1 Table.

K. K. Mock et al.; *Sample Immobilization Protocols for Matrix–assisted Laser–desorption Mass Spectrometry*, Rapid. Commun. Mass Spectrom. vol. 6, 1992, 16: pp. 233–238, 6 Figs.

Randall W. Nelson; *The Use of Bioreactive Probes in Protein Characterization*, Mass Spectrometry Reviews, 1997; 16, pp. 353–376, 25 Figs.

Maria Esteban Warren et al.; *On–Probe Solid–Phase Extraction/MALDI–MS Using Ion–Pairing Interactions for the Cleanup of Peptides and Proteins*, Analytical Chemistry, vol. 70, No. 18, Sep. 15, 1998, pp. 3757–3683, 6 Figs.

Hendrik Neubert et al.; *Enhanced Affinity Capture MALDI–TOF MS: Orientation of an Immunoglobulin G Using Recombinant Protein G, Analytical Chemistry*, vol. 74, No. 15, Aug. 1, 2002, pp. 3677–3683, 6 Figs.

Martin Schuerenberg et al.; *Prestructured MALDI–MS Sample Supports*, Analytical Chemistry, vol. 72, No. 16, Aug. 1, 2000, pp. 3436–3442, 6 Figs.

Jesus Ching et al.; *Surface Chemistries Enabling Photoinduced Uncoupling/Desorption of Covalently Tethered Biomolecules*, J. Org. Chem. 1996, vol. 61, pp. 3582–3583, 2 Figs., 1 Table.

Adam H. Brockman et al.; *New Immobilization Chemistry for Probe Affinity Mass Spectrometry*, Rapid. Commun. Mass Spectrom. vol. 10, 1996, pp. 1688–1692, 5 Figs.

T. William Hutchens, et al.; *New Desorption Strategies for the Mass Spectrometric Analysis of Macromolecules*, Rapid Communications in Mass Spectrometry, 1993; vol. 7, pp. 576–580, 4 Figs.

* cited by examiner

MALDI SAMPLE PLATE

CROSS-REFERENCE TO RELATED APPLICATIONS

This application claims priority from GB-0120131.8 filed 17Aug. 2001.

BACKGROUND OF THE INVENTION

1. Field of the Invention

The present invention relates to MALDI sample plates.

2. Description of the Related Art

Matrix Assisted Laser Desorption Ionisation ("MALDI") ion sources are typically used in conjunction with Time of Flight ("TOF") mass spectrometers to analyse macro molecular samples such as peptides, proteins, polymers, DNA, RNA, intact bacteria or cells, carbohydrates, sugars etc.

In MALDI mass spectrometry, analyte is mixed with a matrix solution in an appropriate solvent and deposited on a MALDI sample plate for subsequent drying and crystallization. During the course of the drying process, crystal growth of the matrix is induced and analyte molecules become co-crystallised with the matrix. The MALDI sample plate is then inserted into a mass spectrometer and a relatively small (e.g. 100 μm diameter) laser beam is directed on to the sample plate. Photon bombardment causes the matrix and the analyte to be desorbed and ionised without substantially fragmenting the analyte. The desorbed ions are then mass analysed in the mass spectrometer. The matrix is an energy absorbing substance which absorbs energy from the laser beam thereby enabling desorption of analyte from the sample plate.

A MALDI sample plate is known which comprises a stainless steel plate coated with a 30–40 μm thick layer of hydrophobic polytetrafluoroethylene (also known as "PTFE" or Teflon (RTM)). 200 μm diameter hydrophilic gold spots are sputtered on to the hydrophobic surface using a photolithographic mask. The spots are spaced at 2.25 mm intervals so as to correspond with microtitre specifications. Small 1 μl sample droplets are then deposited on to the hydrophilic gold spots. After the solvent in the sample droplet has evaporated, the sample is deposited solely upon the 200 μm gold spots due to the strongly water repellent nature of the surrounding PTFE surface.

SUMMARY OF THE INVENTION

According to a first aspect of the present invention, there is provided a MALDI sample plate comprising:

a substrate comprising a plurality of sample regions, wherein each sample region comprises:

a laser etched portion formed in the substrate;

a first portion surrounding at least part, preferably the whole, of the laser etched portion; and a groove or raised portion surrounding at least part, preferably the whole, of the first portion;

wherein the sample plate further comprises:

a first layer disposed on at least part, preferably the whole, of the first portion wherein the first layer comprises a first hydrophobic material.

A particular advantageous feature of the preferred embodiment is that the MALDI sample plate can handle larger volumes of analyte e.g 5–10 μl than the known MALDI sample plate.

A further important advantage of the preferred MALDI sample plate is that the sample plate can be washed once samples have been deposited on the plate prior to mass analysis i.e. samples can be concentrated and cleaned directly on the surface of the MALDI sample plate. Sample preconcentration and effective sample purification by washing away of sample contaminants greatly increases sensitivity over conventional sample preparation methods using known MALDI sample plates. It has been found that using a MALDI sample plate according to the preferred embodiment it is possible to detect and analyse peptide and protein samples at sub femto mole per μl concentration levels when the samples contain significant levels of salt contaminants. This represents a significant advance in the art.

Preferably, the first layer may also be disposed on the groove or raised portion which helps define the perimeter of the sample region.

The first layer may comprise either polystyrene or polytetrafluoroethylene.

The first layer preferably has a thickness selected from the group consisting of: (i)≦5 μm; (ii) 5–10 μm; (iii) 10–15 μm; (iv) 15–20 μm; (v) 20–25 μm; (vi) 25–30 μm; (vii) 30–35 μm; (viii) 35–40 μm; (ix) 40–45 μm; (x) 45–50 μm; (xi) 50–55 μm; (xii) 55–60 μm; (xiii) 60–65 μm; (xiv) 65–70 μm; (xv) 70–75 μm; (xvi) 75–80 μm; (xvii) 80–85 μm; (xviii) 85–90 μm; (xix) 90–95 μm; (xx) 95–100 m; and (xxi)>100 μm. According to a particularly preferred embodiment, the first layer may be 60–100 μm thick.

Preferably, the contact angle of a solvent or water droplet with the first hydrophobic material is selected from the group consisting of: (i)≧90°; (ii)≧95°; (iii)≧100°; (iv)≧105°; (v)≧110°; (vi)≧115°; and (vii) 110–114°.

The laser etched portion is preferably arranged centrally within the sample region and preferably comprises a roughened region of the substrate. The laser etched portion may include residual polymerised material which was a hydrophobic substance prior to the laser etched portion being formed.

A second layer is preferably disposed on at least the laser etched portion and may also be disposed on the first portion and the groove or raised portion.

Preferably, the second layer comprises a second hydrophobic material such as either polystyrene or polytetrafluoroethylene.

Preferably, the second layer has a thickness selected from the group consisting of: (i)≦100 μm; (ii)≦90 μm; (iii)≦80 μm; (iv)≦70 μm; (v)≦60 μm; (vi)≦50 μm; (vii) ≦40 m; (viii)≦30 μm; (ix)≦20 m; (x)≦10 μm; (xi)≦5 μm; (xii)≦1 μm; (xiii)≦100 nm; (xiv)≦10 μm; and (xv)≦1 μm. In one embodiment the second layer may be a single monolayer thick. In other embodiments the second layer may be a few monolayers thick. According to a particularly preferred embodiment the second layer is substantially thinner than the thickness of the first layer.

The contact angle of a solvent or water droplet with the second hydrophobic material is preferably selected from the group consisting of: (i)≧90°; (ii)≧95°; (iii)≧100°; (iv)≧105°; (v)≧110°; (vi)≧115°; and (vii) 110–114°.

The substrate may be metallic, plastic, ceramic, a semiconductor or glass. The groove or raised portion is preferably substantially circular and the groove may form a dry moat.

In one embodiment the groove or raised portion has an inner diameter selected from the group consisting of: (i) 2.0–2.2 mm; (ii) 2.2–2.4 mm; (iii) 2.4–2.6 mm; (iv) 2.6–2.8 mm; and (v) 2.8–3.0 mm. The groove may have a depth or the raised portion may have a height selected from the group consisting of: (i) 0.10–0.12; (ii) 0.12–0.14; (iii) 0.14–0.16; (iv) 0.16–0.18; (v) 0.18–0.20; (vi) 0.20–0.22 mm; (vii) 0.22–0.24 mm; (viii) 0.24–0.26 mm; (ix) 0.26–0.28 mm; (x) 0.28–0.30 mm; (xi) 0.30–0.32 mm; (xii) 0.32–0.34 mm; (xiii) 0.34–0.36 mm; (xiv) 0.36–0.38 mm; (xv) 0.38–0.40 mm; (xvi) 0.40–0.42 mm; (xvii) 0.42–0.44 mm; (xviii) 0.44–0.46 mm; (xix) 0.46–0.48 mm; and (xx) 0.48–0.50 mm. The laser etched portion may have a diameter selected from the group consisting of: (i) 0.2–0.4 mm; (ii) 0.4–0.6 mm; (iii) 0.6–0.8 mm; (iv) 0.8–1.0 mm; (v) 1.0–1.2 mm; (vi) 1.2–1.4 mm; (vii) 1.4–1.6 mm; and (viii) 1.6–1.8 mm.

According to another embodiment, the groove or raised portion may have an inner diameter selected from the group consisting of: (i) 1.0–1.2 mm; (ii) 1.2–1.4 mm; (iii) 1.4–1.6 mm; (iv) 1.6–1.8 mm; and (v) 1.8–2.0 mm. The groove may have a depth or the raised portion may have a height selected from the group consisting of: (i) 0.10–0.12; (ii) 0.12–0.14; (iii) 0.14–0.16; (iv) 0.16–0.18; (v) 0.18–0.20; (vi) 0.20–0.22 mm; (vii) 0.22–0.24 mm; (viii) 0.24–0.26 mm; (ix) 0.26–0.28 mm; (x) 0.28–0.30 mm; (xi) 0.30–0.32 mm; (xii) 0.32–0.34 mm; (xiii) 0.34–0.36 mm; (xiv) 0.36–0.38 mm; (xv) 0.38–0.40 mm; (xvi) 0.40–0.42 mm; (xvii) 0.42–0.44 mm; (xviii) 0.44–0.46 mm; (xix) 0.46–0.48 mm; and (xx) 0.48–0.50 mm. The laser etched portion may have a diameter selected from the group consisting of: (i) 0.2–0.4 mm; (ii) 0.4–0.6 mm; (iii) 0.6–0.8 mm; and (iv) 0.8–1.0 mm.

Large format embodiments are also contemplated wherein the groove or raised portion has an inner diameter of 3–4 mm, 4–5 mm, 5–6 mm, 6–7 mm, 7–8 mm, 8–9 mm, 9–10 mm or >10 mm. Such embodiments would enable a sample of up to 100 $\mu$l to be deposited.

The laser etched portion may have peaks and troughs which are separated by an average distance selected from the group consisting of: (i) 100–90 $\mu$m; (ii) 90–80 $\mu$m; (iii) 80–70 m; (iv) 70–60 $\mu$m; (v) 60–50 $\mu$m; (vi) 50–40 $\mu$m; (vii) 40–30 $\mu$m; (viii) 30–20 $\mu$m; (ix) 20–10 $\mu$m; and (x) 10–1 $\mu$m.

Preferably, the laser etched portion has the effect of drawing in a sample solution deposited on the sample plate as the volume reduces. It is believed that this may be due to the substantially increased surface area of the laser etched region.

The sample plate may be arranged in a microtitre format so that the pitch spacing between samples is approximately or exactly 18 mm, 9 mm, 4.5 mm, 2.25 mm, or 1.125 mm. Up to 48, 96, 384, 1536 or 6144 samples may be arranged to be received on the sample plate. Samples may be arranged to be deposited on the sample plate in a pattern of four samples about a central control sample well.

According to a second aspect of the present invention, there is provided the combination of a MALDI sample plate and bio-molecules deposited on to the sample plate.

According to a third aspect of the present invention, there is provided a MALDI mass spectrometer in combination with a MALDI sample plate.

According to a fourth aspect of the present invention, there is provided a sample plate for use in mass spectrometry comprising:

a substrate comprising a plurality of sample regions, wherein each sample region comprises:

a perimeter defining the sample region;

an etched, roughened or indented portion within the perimeter and formed in the substrate; and a hydrophobic surface surrounding and/or covering the etched, roughened or indented portion within the perimeter.

Preferably, the perimeter comprises a groove or a raised portion.

Less preferred embodiments are contemplated wherein the etched, roughened or indented portion and the hydrophobic surface surrounding the etched, roughened or indented portion are above or below the surface of the substrate.

According to a fifth aspect of the present invention, there is provided a sample plate for use in mass spectrometry comprising:

a plurality of roughened, etched or indented regions each coated with a material having a surface energy selected from the group consisting of: (i) <72 dynes/cm; (ii)≦70 dynes/cm; (iii)≦60 dynes/cm; (iv)≦50 dynes/cm; (v)≦40 dynes/cm; (vi)≦30 dynes/cm; (vii)≦20 dynes/cm; and (viii)≦10 dynes/cm; and a groove or raised portion surrounding each roughened, etched or indented region.

According to a sixth aspect of the present invention, there is provided a method of mass spectrometry, comprising the step of using a preferred MALDI sample plate.

According to a seventh aspect of the present invention, there is provided a method of sample preparation comprising the step of:

automatically or manually spotting samples on to a preferred MALDI sample plate.

According to an eighth aspect of the present invention, there is provided a method of sample preparation comprising the step of:

automatically or manually washing samples deposited on to a preferred MALDI sample plate.

According to a ninth aspect of the present invention, there is provided a method of mass spectrometry comprising the step of:

automatically or manually analysing analyte deposited on to a preferred MALDI sample plate.

According to a tenth aspect of the present invention, there is provided a method of making a MALDI sample plate, comprising the steps of:

providing either a substrate having a hydrophobic coating on at least part, preferably the whole, of the surface of the substrate or a hydrophobic substrate;

etching, roughening or indenting at least one etched, roughened or indented portion in the substrate by either: (i) laser ablation; (ii) chemical etching; (iii) electrochemical etching; (iv) mechanical etching; (v) electronbeam etching; or (vi) mechanical pressing; and coating at least a portion of the at least one etched, roughened or indented portion with a film of hydrophobic material.

Preferably, substantially the whole of the etched, roughened or indented portion is coated with the film. Further preferably, a substantial portion of the substrate is coated with the film. Preferably, the substrate has a groove or raised portion surrounding the at least one etched, roughened or indented portion.

According to an eleventh aspect of the present invention, there is provided a method of making a sample plate for use in mass spectrometry, comprising the steps of:

providing a substrate having a hydrophobic surface and having a plurality of sample regions defined by a plurality of grooves or raised portions;

forming a roughened, etched or indented region within at least some of the sample regions; and coating at least a portion of at least some of the roughened, etched or indented regions with a hydrophobic material.

According to a twelfth aspect of the present invention, there is provided a method of preparing a sample on a MALDI sample plate, comprising:

providing a MALDI sample plate comprising a roughened, etched or indented region having a hydrophobic coating on at least a portion of the region; and depositing sample(s) on to the MALDI sample plate, each the sample(s) having a volume selected from the group consisting: (i) 2–4 μl; (ii) 4–6 μl; (iii) 6–8 μl; (iv) 8–10 μl; (v) 10–12 μl; (vi) 12–14 μl; (vii) 14–16 μl; (viii) 16–18 μl; (ix) 18–20 μl; (x) 20–30 μl; (xi) 30–40 μl; (xii) 40–50 μl; (xiii) 50–60 μl; (xiv) 60–70 μl; (xv) 70–80 μl; (xvi) 80–90 μl; and (xvii) 90–100 μl.

Advantageously, larger volumes of sample can be deposited on to the preferred sample plate compared to conventional techniques.

According to a thirteenth aspect of the present invention, there is provided a method of preparing a sample on a MALDI sample plate, comprising:

providing a MALDI sample plate comprising a roughened, etched or indented region having a hydrophobic coating on at least a portion of the region;

depositing sample(s) which include analyte on to the MALDI sample plate so that the sample(s) attaches to the roughened, etched or indented region;

allowing the sample(s) to reduce in volume and so concentrate analyte on to the roughened, etched or indented region; and then washing the MALDI sample plate.

According to a fourteenth aspect of the present invention, there is provided a method of automatically preparing a sample on a sample plate, comprising:

providing a sample plate;

automatically depositing sample(s) on to the sample plate so that sample(s) attaches to part of the sample plate comprising a roughened, etched or indented region having a hydrophobic coating on at least a portion of the region;

allowing the sample to reduce in volume and so concentrate analyte on to the roughened, etched or indented region; and then automatically washing the sample plate.

According to a fifteenth aspect of the present invention, there is provided a method of sample preparation comprising the step of:

automatically or manually chemically destaining gel or membrane samples in situ on a preferred MALDI sample plate.

Destaining is the process of removing a chemical stain that is used to detect the presence of protein, protein related material, DNA or RNA in either a polyacrylamide gel, or a membrane, by forming a chemical reaction with the amino acids present in the protein backbone. Destaining involves washing with a variety of aqueous and organic solvents.

According to a sixteenth aspect of the present invention, there is provided a method of sample preparation comprising the step of:

automatically or manually chemically reducing samples in situ a preferred MALDI sample plate.

Reduction is a means of chemically reducing any disulphide (S—S) bridges that may be present in the protein structure, by treating with a reducing agent, such as but not limited to dithiothretal (DTT), mercaptoethanol and TCEP.

According to a seventeenth aspect of the present invention, there is provided a method of sample preparation comprising the step of:

automatically or manually chemically alkylating samples in situ on a preferred MALDI sample plate.

Alkylation is the chemical modification of cysteine residues, present in the protein or polypeptide such that disulphide bridges may not reform.

According to an eighteenth aspect of the present invention, there is provided a method of sample preparation comprising the step of:

automatically or manually tryptically or chemically digesting samples in situ on to a preferred MALDI sample plate.

Enzymatic or chemical digestion is the use of a chemical or enzymatic method to make shorter lengths of polypeptide from a protein, by cleaving either specifically or non-specifically at the N or C-terminal side of the peptide bond.

According to a nineteenth aspect of the present invention, there is provided a method of sample preparation comprising the step of:

automatically or manually chemically derivatising samples deposited on to a preferred MALDI sample plate.

Derivatisation is any modification of a protein, peptide, DNA or RNA that chemically changes the molecule. This is primarily used to either enhance the ionisation of the molecule by mass spectrometry, improve the fragmentation of the protein/peptide or to allow relative quantitative measurements to be made.

According to a twentieth aspect of the present invention, there is provided a method of sample preparation comprising the step of:

automatically or manually washing samples in situ on a preferred MALDI sample plate in order to remove gel or membrane samples and/or other contaminants.

According to a twenty-first aspect of the present invention, there is provided a method of sample preparation comprising at least two, three, four, five or six of the following steps:

(i) automatically or manually chemically destaining gel or membrane samples in situ on a MALDI sample plate;

(ii) automatically or manually chemically reducing samples in situ on a MALDI sample plate;

(iii) automatically or manually chemically alkylating samples in situ on a MALDI sample plate;

(iv) automatically or manually tryptically or chemically digesting samples in situ on a MALDI sample plate;

(v) automatically or manually chemically derivatising samples in situ a MALDI sample plate; and (vi) automatically or manually washing samples in situ on a MALDI sample plate in order to remove gel or membrane samples and/or other contaminants, wherein the MALDI sample plate is a preferred MALDI sample plate.

Examples of the more important features of the invention thus have been summarized rather broadly in order that the detailed description thereof that follows may be better understood, and in order that the contributions to the art may be appreciated. There are, of course, additional features of the invention that will be described hereinafter and which will form the subject of the claims appended hereto.

BRIEF DESCRIPTION OF THE DRAWINGS

For detailed understanding of the present invention, references should be made to the following detailed description of the preferred embodiment, taken in conjunction with the accompanying drawings, in which like elements have been given like numerals and wherein:

FIG. 1(*b*) shows a side view of the MALDI sample plate;

DESCRIPTION OF PREFERRED EMBODIMENTS

By way of background, if a substance is hydrophobic then it will be repelled by water or other highly polar molecules. More specifically, the water molecules tend to repel other non-polar molecules that cannot form hydrogen bonds thereby causing non-polar or hydrophobic molecules to aggregate together (this is also known as the "hydrophobic interaction"). Conversely, water molecules tend to attract and dissolve polar molecules or hydrophilic molecules that can form hydrogen bonds with the water. Hydrophobic interaction is the result of electrostatic forces between polar molecules. These are responsible for pushing hydrophobic molecules together or towards other hydrophobic material such as the reverse phase material in liquid chromatography. This term is sometimes confused with the term affinity which is an attractive force.

One way of observing hydrophobicity is to observe the contact angle formed between a water droplet or solvent and a substrate. Generally, the higher the contact angle the more hydrophobic the surface. For example, the contact angle between water and PTFE is about 112°. Generally if the contact angle of a liquid on a substrate is less than 90° then the material is said to be wettable (and hence more hydrophilic) by the liquid where the less the angle the greater the level of spreading. If the contact angle is greater than 90° then the material is said to be non wettable (and hence more hydrophobic).

The surface energy of a solid can also be used to give an indication of hydrophobicity. The lower the surface energy of a solid substrate the greater the contact angle because the molecules of the substrate are not attracting the molecules of the liquid. For example, PTFE has a surface energy of 18 dynes/cm, polystyrene 33 dynes/cm, water 72 dynes/cm and stainless steel 700–1100 dynes/cm. The lower the surface energy the more hydrophobic the material is and conversely, the higher the surface energy the more hydrophilic the material is.

Figure 1:
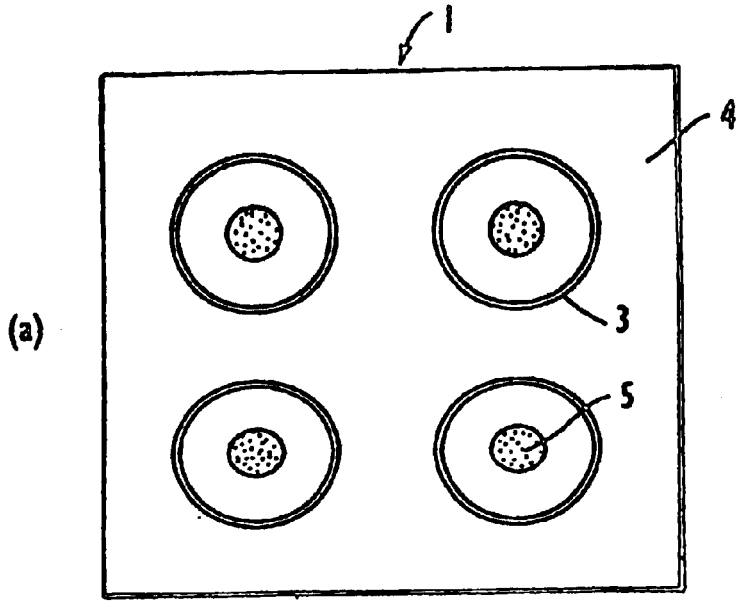
FIG. 1(*a*) shows a plan view of a preferred MALDI sample plate.
Figure 1:
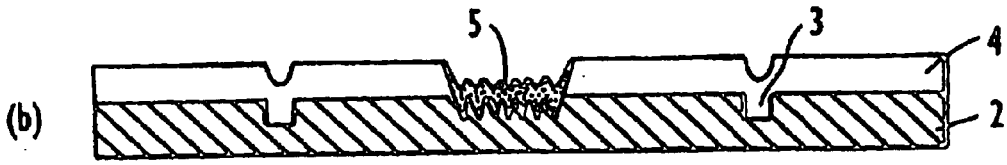

A preferred MALDI target or sample plate 1 will now be described with regard to FIG. 1. The sample plate 1 comprises a flat conductive metal plate or substrate 2, preferably stainless steel. The substrate 2 is etched, preferably by a laser, so that a number of circular moat portions or grooves 3 are produced in the substrate 2. Each circular moat portion or groove 3 defines a sample position.

A high density of sample positions may be provided on the sample plate 1. For ease of illustration only four sample positions are shown in FIG. 1, but according to an embodiment 96 sample positions and 24 reference positions may be provided on a 55 mm×40 mm steel plate. The steel plate 2 is approximately 2.5 mm thick.

The circular moats 3 have a diameter of approximately 2.5 mm and each moat 3 is approximately 0.25 mm wide and 0.25 deep.

Substrate 2 is coated with a hydrophobic material such as polytetrafluoroethylene ("PTFE") which creates a layer approximately 100 $\mu$m thick or less. As shown in FIG. 1(*b*), because of the moat portions 3 there is a dip in the PTFE layer 4 above the corresponding moat 3.

A laser etched region 5 is then made in the centre of each sample portion by laser etching or ablation. Each laser etched region 5 has a diameter of approximately 0.4–0.6 mm. The precise structure of the laser etched region 5 has not been fully investigated but the steel substrate 2 underneath the upper surface of the laser etched region 5 is roughened or indented by the laser etching process. The laser etching process is believed to remove some or all of the PTFE coating leaving behind a roughened region which is presumed to have a large surface area. The laser etched region 5 is a roughened region having peaks and troughs. The peak to valley height is approximately 30 $\mu$m.

Once the laser etched regions 5 have been formed, a thin layer of hydrophobic material preferably polystyrene is applied across at least the roughened laser etched region 5. It may also be applied across substantially the whole of the upper surface of the sample plate 1.

A preferred sample preparation protocol will now be described.

A sample is preferably deposited in a relatively large volume of 5–10 $\mu$l compared to the sample protocol used with the known sample plate. The sample solution preferably contains analyte and a solvent such as 20–30% acetonitrile ("ACN").

The large volume sample loading of 5–10 $\mu$l is possible because the hydrophobic surface provides an increased contact angle with the sample solution compared to a stainless steel sample plate. In addition, the sample moat geometry maintains the high contact angle and acts as a barrier to the droplet perimeter. The combination of both the hydrophobic surface and the sample moat 3 gives an approximate 5–10 fold improvement in sample volume retention.

The solvent in the sample solution is allowed to evaporate. During the evaporation the solution droplet is immobilised onto the roughened laser etched regions 5. Biomolecules preferentially aggregate on the enlarged hydrophobic surfaces due to hydrophobic interactions. Although both PTFE and polystyrene are highly hydrophobic, it is believed that the relatively large surface area of the hydrophobic coating in the micro structure of the roughened laser etched region 5 allows accommodation of a relatively large proportion of the sample over the large surface area of the hydrophobic material within the roughened laser etched regions 5.

Once the solvent has completely evaporated the analyte bio-molecules are immobilised to the enlarged surface area of hydrophobic coating within the laser etched regions 5.

According to a particularly preferred embodiment, the sample plate 1 can then be submerged in water to wash the sample and to remove impurities such as inorganic salts. The washed sample can then be analysed directly on the sample plate 1 by the addition of a small volume (1 μl) of matrix.

The matrix preferably comprises α-cyano-4-hydroxycinnamic acid (CHCA). However, other matrices such as 2,5-dihydroxybenzoic acid (DHB), hydroxypicolinic acid (HPA), 3,5-dimethoxy-4-hydroxycinnamic acid (Sinapinic acid), glycerol, succinic acid, thiourea, 2-(4-hydroxypheylazo)benzoic acid (HABA), esculetin and 2,4,5-trihydroxyacetophenone may be used.

The matrix solvent preferably has a high organic content typically 70–90%. The matrix solvent dissociates the bio-molecules from the roughened laser etched region so allowing the co-crystallisation of analyte and matrix. The matrix droplet is also immobilised onto the roughened laser etched region 5 and this ensures that the sample is crystallised in a small area.

Figure 2:
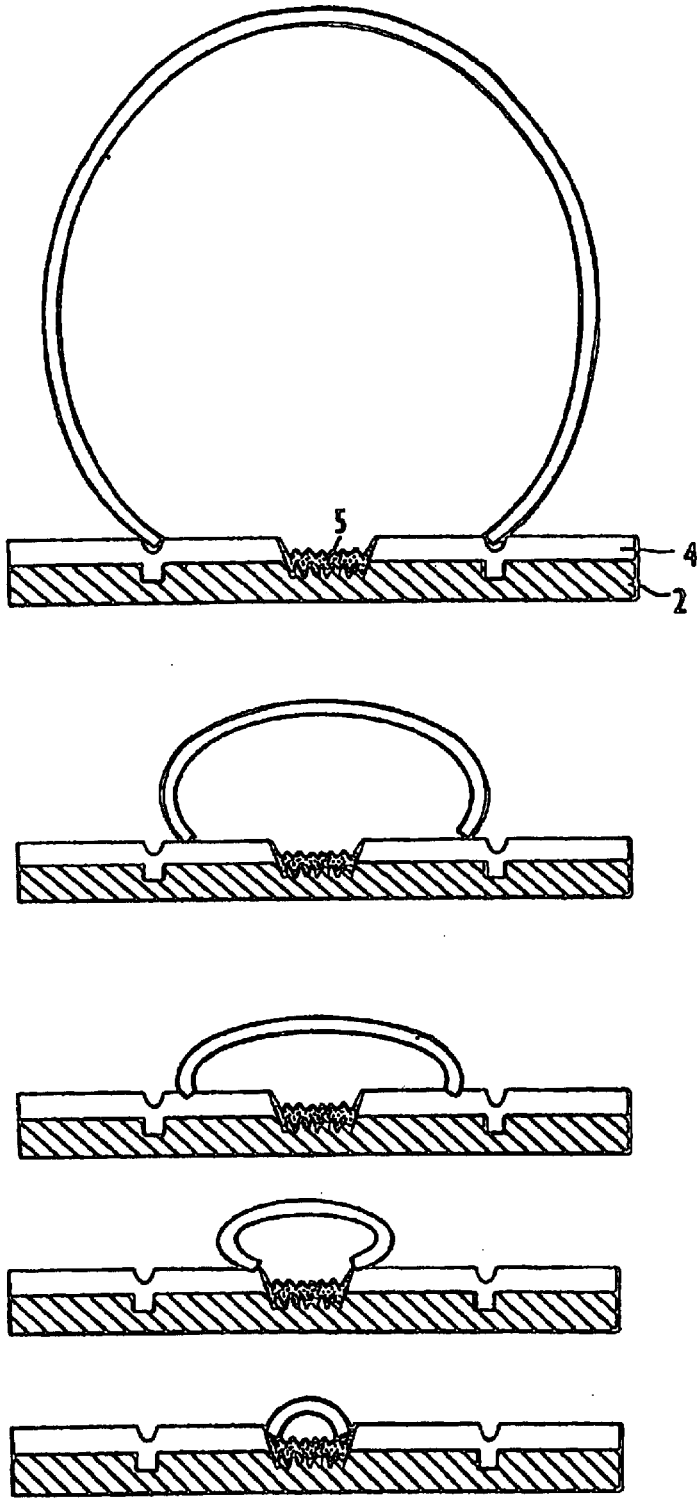
FIG. 2 shows a sample being deposited on to a sample plate and contracting as the solvent evaporates.

FIG. 2 shows a sample being deposited on to a sample plate and progressively contracting as the solvent evaporates.

Figure 3:
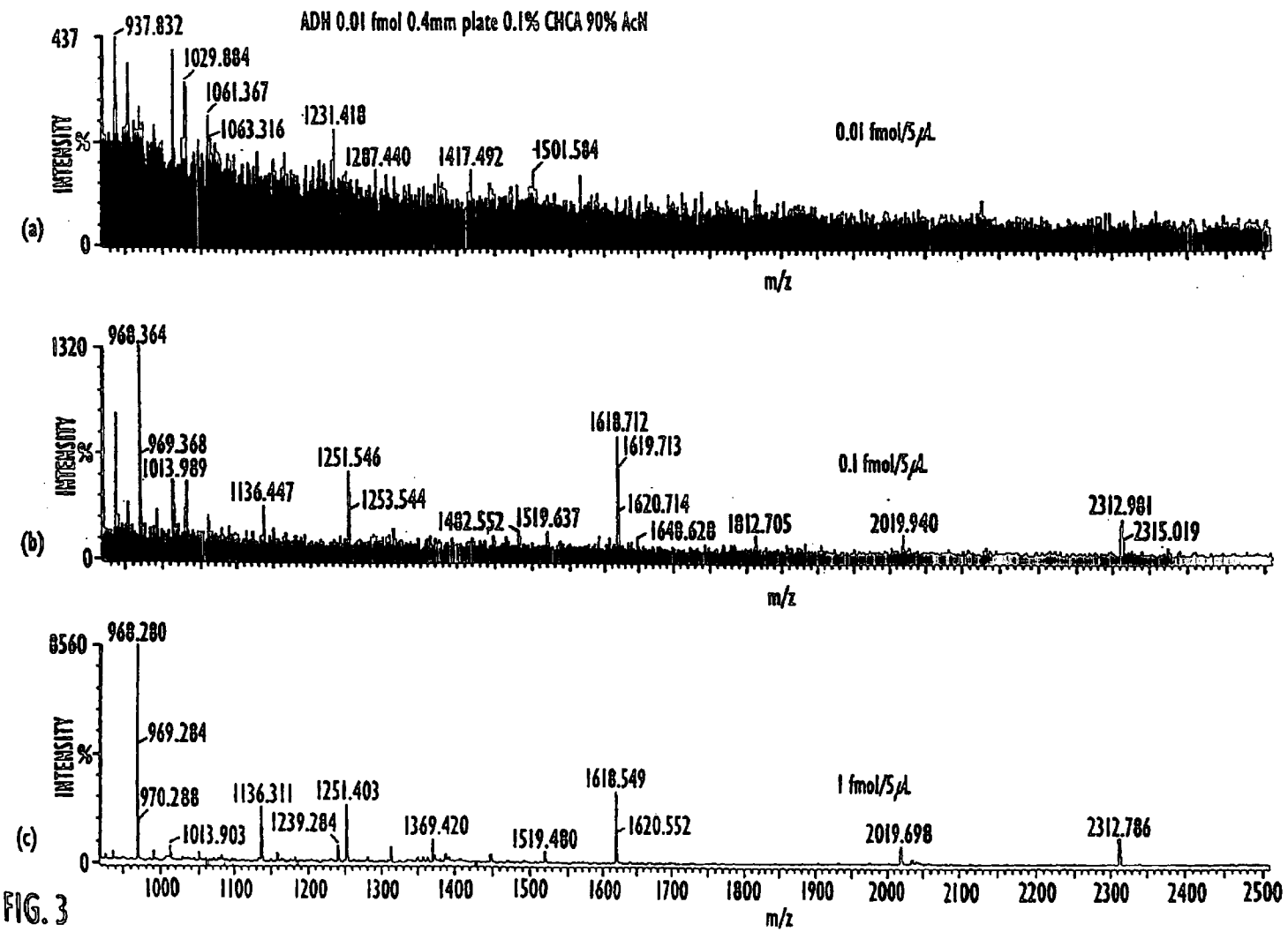
FIG. 3(*a*) shows a mass spectrum of ADH protein digest deposited on to a preferred MALDI sample plate at a concentration of 2 attomole/$\mu$l, FIG. 3(*b*) shows a mass spectrum of ADH protein digest deposited on to a preferred MALDI sample plate at a concentration of 20 attomole/$\mu$l, and FIG. 3(*c*) shows a mass spectrum of ADH protein digest deposited on to a preferred MALDI sample plate at a concentration of 200 attomole/$\mu$l.

FIGS. 3(*a*)–(*c*) show three mass spectra of an in solution tryptic digest sample of Alcohol Dehydrogenase (ADH) protein showing the sensitivity and focusing of different concentrations using the sample plate according to the preferred embodiment. Each sample volume loaded was 5 μl. The sample concentrations were 2 attomole/μl (0.01 fmol), 20 attomole/μl (0.1 fmol) and 200 attomole/μl. As is readily apparent from FIGS. 3(*a*) and (*b*), the detection limit of tryptic peptides using the preferred MALDI sample plate 1 and sample preparation protocols is very low (between 2 and 20 attomole/μl).

Figure 4:
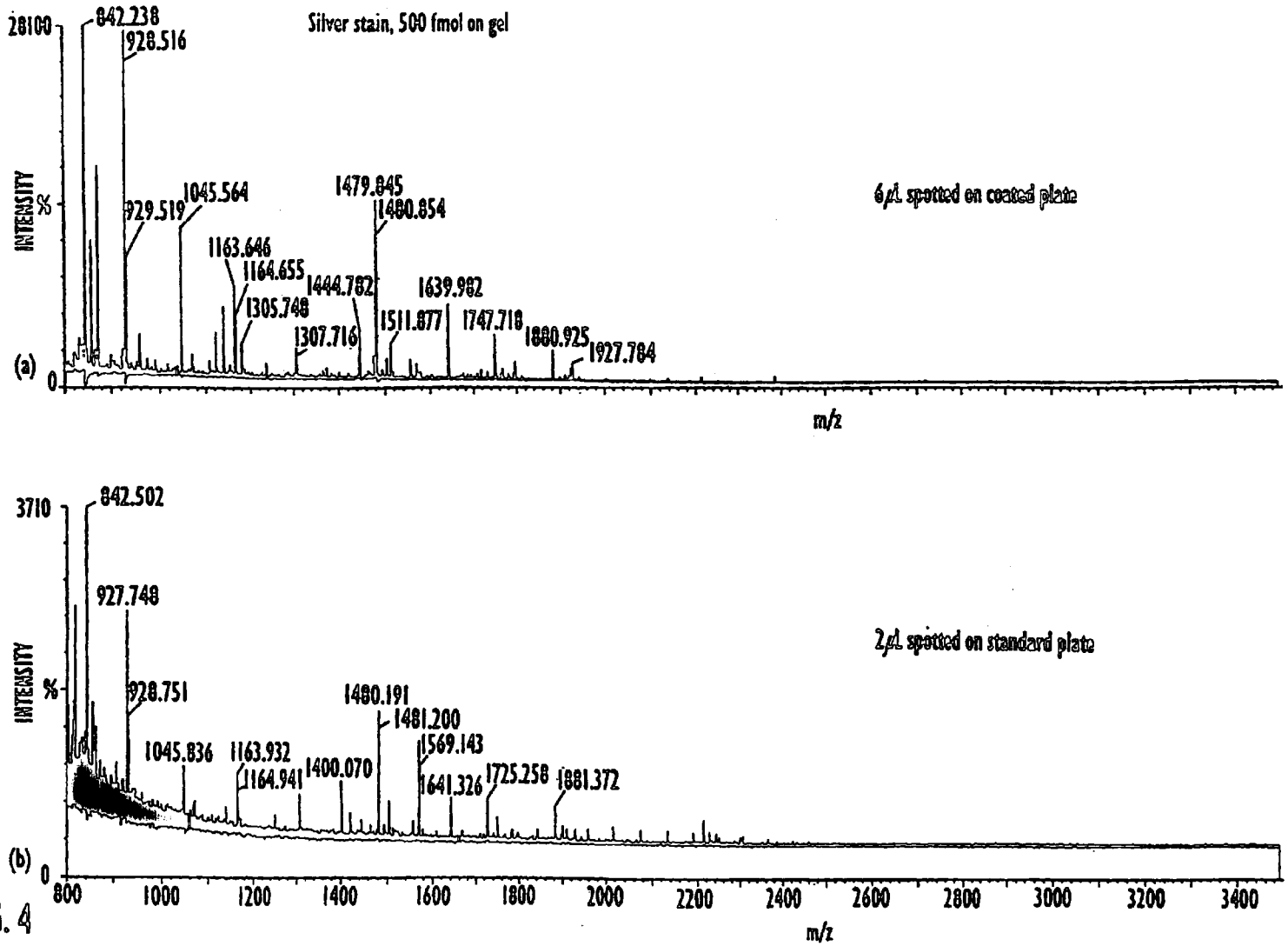
FIGS. 4(*a*) and (*b*) show comparative mass spectra from a digest sample of BSA protein (500 fmol originally loaded onto gel) which was spotted onto a preferred MALDI sample plate and a conventional MALDI sample plate.

FIGS. 4(*a*) and (*b*) shows mass spectra from a 500 fmol digest sample of BSA protein that was injected onto a 1D gel plate (Bio-Rad (RTM)). The gel was silver stained and the protein band was cut out and processed using Micromass Massprep (RTM) automated sample preparation station. The automated sample processing included destaining of the cut out gel pieces, reduction and alkylation, tryptic digestion, conditioning and spotting onto the MALDI sample plate 1, washing in situ on the MALDI sample plate 1 (to remove salts) and finally addition of matrix onto the MALDI sample plate 1. FIG. 4(*a*) shows the resultant mass spectrum where the Massprep loaded 6 μl (from a total of 20 μl produced) onto a preferred MALDI sample plate 1 and FIG. 4(*b*) shows the resultant mass spectrum with a standard loading of 2 μl onto a conventional MALDI plate. The mass spectra shown in FIGS. 5(*a*) and (*b*) and FIGS. 6(*a*) and (*b*) were obtained following the same method and using the same sample as described in relation to FIGS. 4(*a*) and (*b*) except that lower amounts of protein were loaded on to the gel (250 fmol and 100 fmol respectively).

Figure 5:
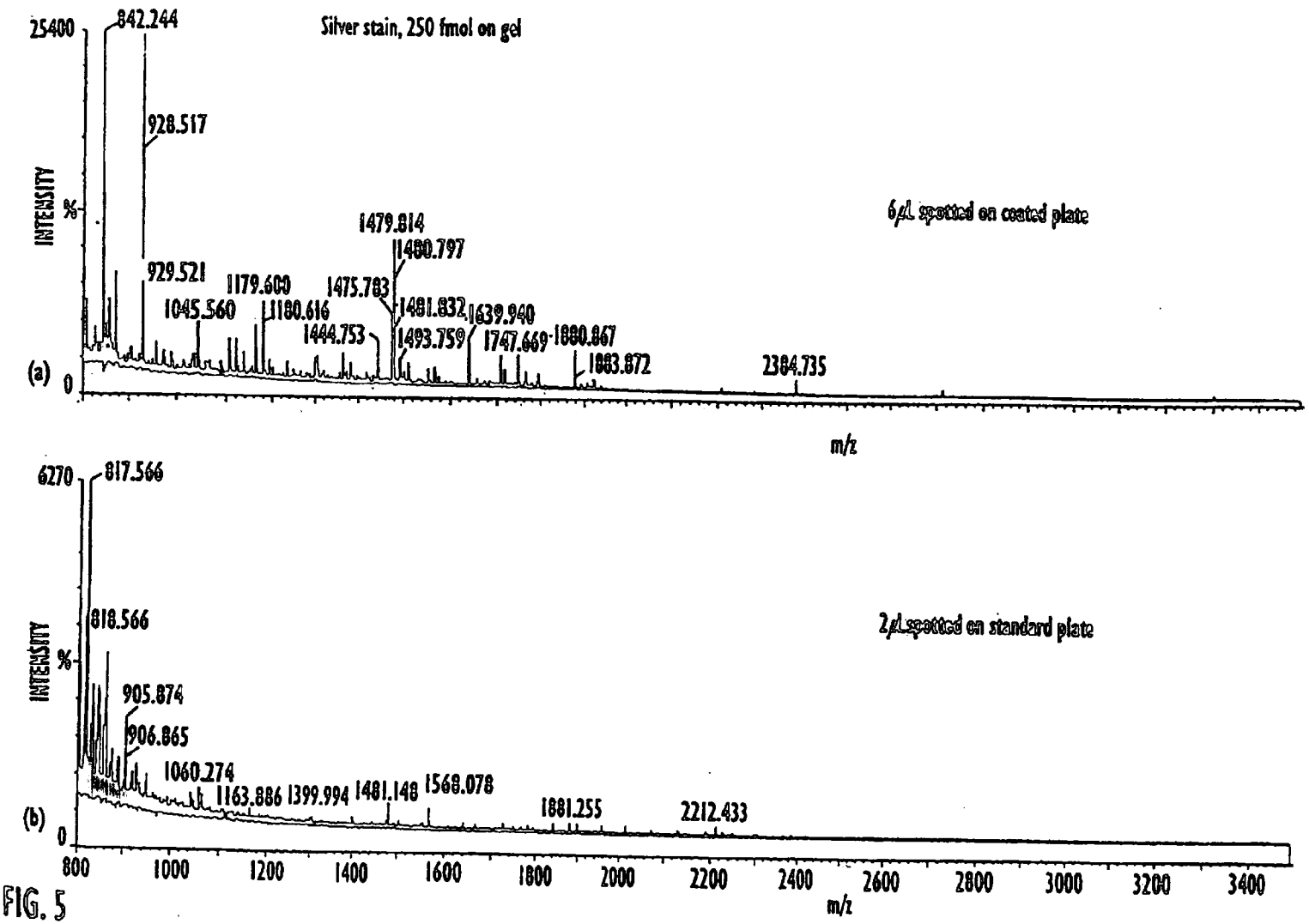
FIGS. 5(*a*) and (*b*) show comparative mass spectra from a digest sample of BSA protein (250 fmol originally loaded onto gel) which was spotted onto a preferred MALDI sample plate and a conventional MALDI sample plate.
Figure 6:
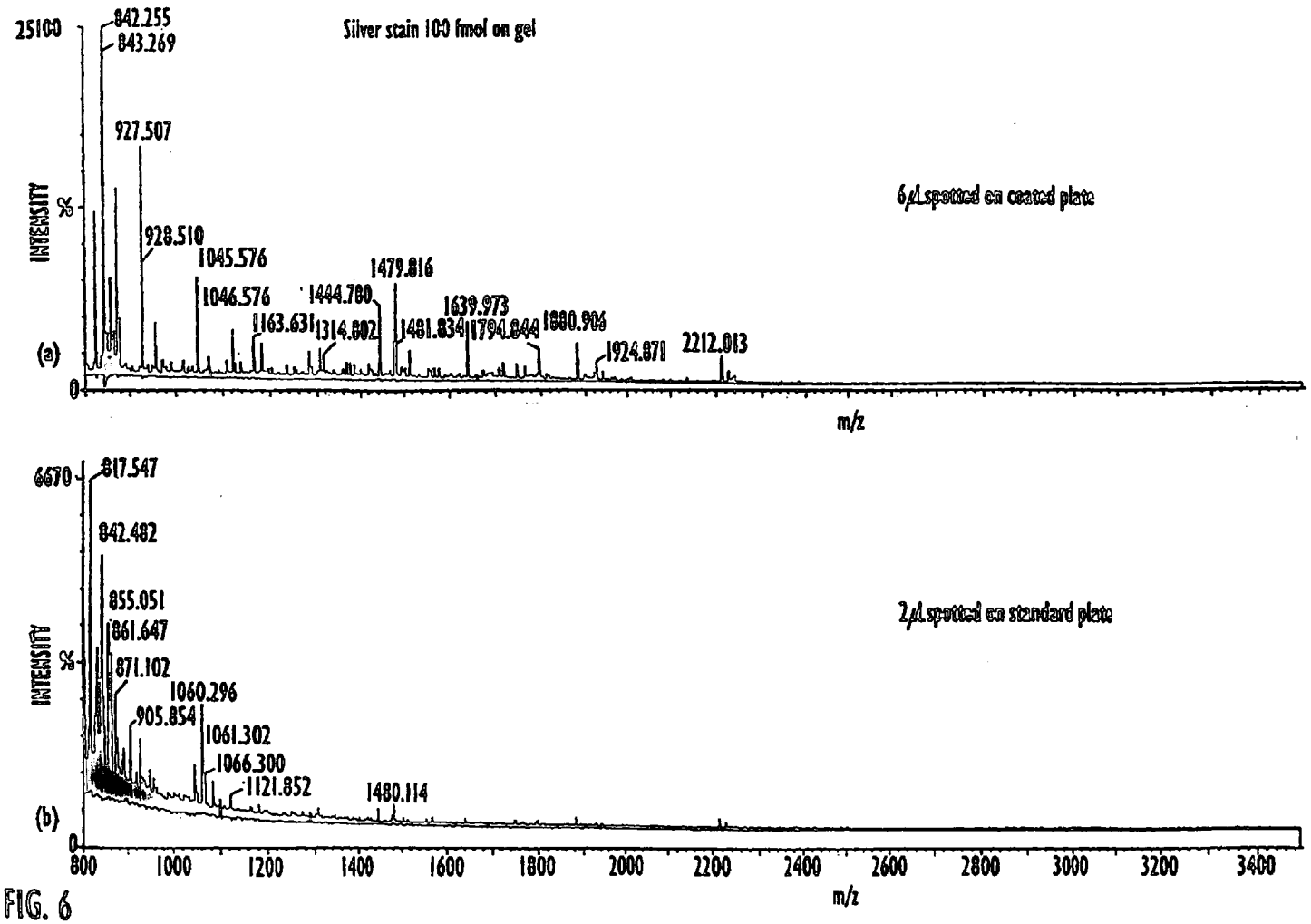
FIGS. 6(*a*) and (*b*) show comparative mass spectra from a digest sample of BSA protein (100 fmol originally loaded onto gel) which was spotted onto a preferred MALDI sample plate and a conventional MALDI sample plate.

As is readily apparent from FIGS. 4–6, the detected intensity of the tryptic peptides is much higher on the preferred MALDI sample plate 1 relative to the standard plate and therefore the ultimate detection limit is significantly lower when using the preferred MALDI sample plate 1.

Figure 7:
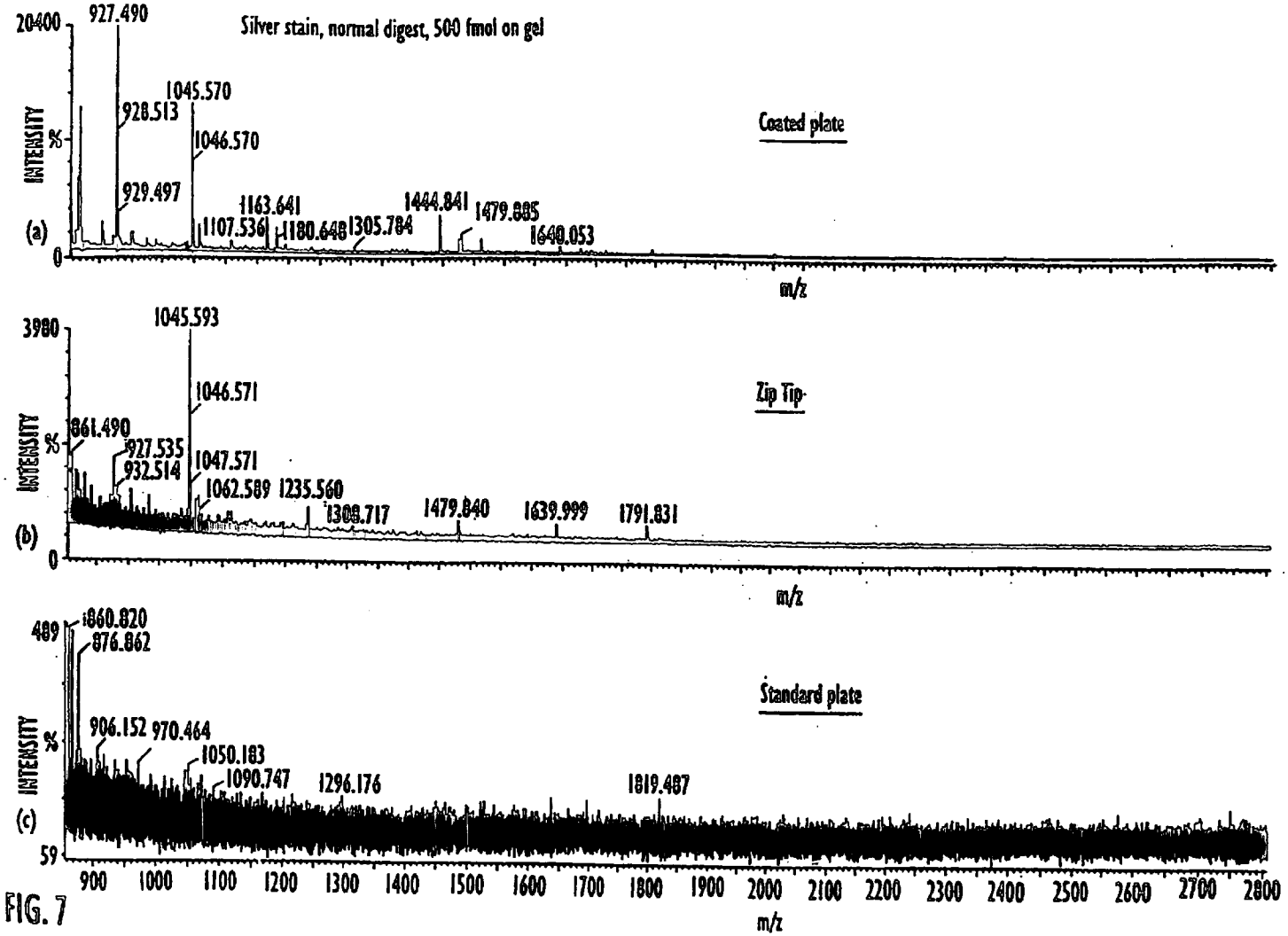
FIG. 7(*a*)–(*c*) show comparative mass spectra from a 500 fmol digest sample of BSA protein which was spotted on to a preferred MALDI sample plate, a conventional MALDI sample plate after Zip Tip sample preparation and a conventional MALDI sample plate.

Finally, FIG. 7 compares mass spectra obtained from using 2 μl of the same sample used to obtain the mass spectra shown in FIGS. 4–6 loaded onto a preferred MALDI sample plate 1 (FIG. 7(*a*)), a standard target plate after Zip Tip sample preparation routine (FIG. 7(*b*)) and a standard stainless steel MALDI sample plate (FIG. 7(*c*)). Zip Tips (C18) involve binding of analytes to C18 material followed by washing away of salts and subsequent elution onto a sample plate. It is not a direct in-situ method and suffers from transfer losses. It also does not work well with hydrophobic peptides or high concentrations of salts and CHAPS etc. As is readily apparent, the preferred MALDI sample plate 1 produces significantly higher signals and lower noise levels than the Zip Tip method. In this experiment no significant signal was observed when using a standard MALDI plate (FIG. 7(*c*)).

The foregoing description is directed to particular embodiments of the present invention for the purpose of illustration and explanation. It will be apparent, however, to one skilled in the art that many modifications and changes to the embodiment set forth above are possible without departing from the scope and the spirit of the invention. It is intended that the following claims be interpreted to embrace all such modifications and changes.

What is claimed is:

1. A MALDI sample plate comprising:

a substrate comprising a plurality of sample regions arranged in a microtitre format, wherein each sample region comprises:

a laser etched portion formed in said substrate, wherein said laser etched portion comprises originally hydrophobic material which has been subsequently polymerized by a laser;

a first portion surrounding at least part or substantially the whole of said laser etched portion;

a groove or raised portion surrounding at least part or substantially the whole of said first portion;

a first layer disposed on at least part or substantially the whole of said first portion, wherein said first layer comprises a first hydrophobic material selected from the group consisting of: (i) polytetrafluoroethylene ("PTFE"); and (ii) polystyrene; and a second layer disposed on at least a part or substantially the whole of said laser etched portion, wherein said second layer comprises a second hydrophobic material selected from the group consisting of: (i) polystyrene; and (ii) polytetrafluoroethylene ("PTFE").

2. A MALDI sample plate as claimed in claim 1, wherein said second layer is also disposed on at least a part or substantially the whole of said first layer.

3. A MALDI sample plate as claimed in claim 1, wherein said second layer is also disposed on at least a part of said first portion.

4. A MALDI sample plate as claimed in claim 1, wherein said second layer is also disposed on at least a part or substantially the whole of said groove or raised portion.

5. A MALDI sample plate as claimed in claim 1, wherein said first layer is also disposed on said groove or raised portion.

6. A MALDI sample plate as claimed in claim 1, wherein said first layer has a thickness selected from the group consisting of: (i) 5 μm; (ii) 5–10 μm; (iii) 10–15 μm; (iv)

15–20 μm; (v) 20–25 μm; (vi) 25–30 μm; (vii) 30–35 μm; (viii) 35–40 μm; (ix) 40–45 μm; (x) 45–50 μm; (xi) 50–55 μm; (xii) 55–60 μm; (xiii) 60–65 μm; (xiv) 65–70 μm; (xv) 70–75 μm; (xvi) 75–80 μm; (xvii) 80–85 μm; (xviii) 85–90 μm; (xix) 90–95 μm; (xx) 95–100 μm; and (xxi) >100 μm.

7. A MALDI sample plate as claimed in claim 1, wherein the contact angle of a solvent or water droplet with said first hydrophobic material is selected from the group consisting of: (i) 90°; (ii) 95°; (iii) 100°; (iv) 105°; (v) 110°; (vi) 115°; and (vii) 110–114°.

8. A MALDI sample plate as claimed in claim 1, wherein said laser etched portion comprises a roughened region of said substrate.

9. A MALDI sample plate as claimed in claim 1, wherein said second layer has a thickness selected from the group consisting of: (i) 100 μm; (ii) 90 μm; (iii) 80 μm; (iv) 70 μm; (v) 60 μm; (vi) 50 μm; (vii) 40 μm; (viii) 30 μm; (ix) 20 μm; (x) 10 μm; (xi) 5 μm; (xii) 1 μm; (xiii) 100 nm; (xiv) 10 nm; (xv) 1 nm; (xvi) 1–5 monolayers; and (xvii) a single monolayer.

10. A MALDI sample plate as claimed in claim 1, wherein the contact angle of a solvent or water droplet with said second hydrophobic material is selected from the group consisting of: (i) 90°; (ii) 95°; (iii) 100°; (iv) 105°; (v) 110°; (vi) 115°; and (vii) 110–114°.

11. A MALDI sample plate as claimed in claim 1, wherein said substrate is selected from the group consisting of: (i) metallic; (ii) plastic; (iii) ceramic; (iv) semiconductor; and (v) glass.

12. A MALDI sample plate as claimed in claim 1, wherein said groove or raised portion is substantially circular.

13. A MALDI sample plate as claimed in claim 1, wherein said groove or raised portion has an inner diameter selected from the group consisting of: (i) 2.0–2.2 mm; (ii) 2.2–2.4 mm; (iii) 2.4–2.6 mm; (iv) 2.6–2.8 mm; and (v) 2.8–3.0 mm.

14. A MALDI sample plate as claimed in claim 13, wherein said groove has a depth or said raised portion has a height selected from the group consisting of: (i) 0.10–0.12 mm; (ii) 0.12–0.14 mm; (iii) 0.14–0.16 mm; (iv) 0.16–0.18 mm; (v) 0.18–0.20 mm; (vi) 0.20–0.22 mm; (vii) 0.22–0.24 mm; (viii) 0.24–0.26 mm; (ix) 0.26–0.28 mm; (x) 0.28–0.30 mm; (xi) 0.30–0.32 mm; (xii) 0.32–0.34 mm; (xiii) 0.34–0.36 mm; (xiv) 0.36–0.38 mm; (xv) 0.38–0.40 mm; (xvi) 0.40–0.42 mm; (xvii) 0.42–0.44 mm; (xviii) 0.44–0.46 mm; (xix) 0.46–0.48 mm; and (xx) 0.48–0.50 mm.

15. A MALDI sample plate as claimed in claim 1, wherein said laser etched portion has a diameter selected from the group consisting of: (i) 0.2–0.4 mm; (ii) 0.4–0.6 mm; (iii) 0.6–0.8 mm; (iv) 0.8–1.0 mm; (v) 1.0–1.2 mm; (vi) 1.2–1.4 mm; (vii) 1.4–1.6 mm; and (viii) 1.6–1.8 mm.

16. A MALDI sample plate as claimed in claim 1, wherein said groove or raised portion has an inner diameter selected from the group consisting of: (i) 1.0–1.2 mm; (ii) 1.2–1.4 mm; (iii) 1.4–1.6 mm; (iv) 1.6–1.8 mm; and (v) 1.8–2.0 mm.

17. A MALDI sample plate as claimed in claim 16, wherein said groove has a depth or said raised portion has a height selected from the group consisting of: (i) 0.10–0.12 mm; (ii) 0.12–0.14 mm; (iii) 0.14–0.16 mm; (iv) 0.16–0.18 mm; (v) 0.18–0.20 mm; (vi) 0.20–0.22 mm; (vii) 0.22–0.24 mm; (viii) 0.24–0.26 mm; (ix) 0.26–0.28 mm; (x) 0.28–0.30 mm; (xi) 0.30–0.32 mm; (xii) 0.32–0.34 mm; (xiii) 0.34–0.36 mm; (xiv) 0.36–0.38 mm; (xv) 0.38–0.40 mm; (xvi) 0.40–0.42 mm; (xvii) 0.42–0.44 mm; (xviii) 0.44–0.46 mm; (xix) 0.46–0.48 mm; and (xx) 0.48–0.50 mm.

18. A MALDI sample plate as claimed in claim 1, wherein said laser etched portion has a diameter selected from the group consisting of: (i) 0.2–0.4 mm; (ii) 0.4–0.6 mm; (iii) 0.6–0.8 mm; and (iv) 0.8–1.0 mm.

19. A MALDI sample plate as claimed in claim 1, wherein said laser etched portion has peaks and troughs which are separated by an average distance selected from the group consisting of: (i) 100–90 μm; (ii) 90–80 μm; (iii) 80–70 μm; (iv) 70–60 μm; (v) 60–50 μm; (vi) 50–40 μm; (vii) 40–30 μm; (viii) 30–20 μm; (ix) 20–10 μm; and (x) 10–1 μm.

20. A MALDI sample plate as claimed in claim 1, wherein said laser etched portion is arranged so as to draw in a sample solution deposited on the sample plate as the volume reduces.

21. A MALDI sample plate as claimed in claim 1, wherein the pitch spacing between samples is approximately or exactly 18 mm, 9 mm, 4.5 mm, 2.25 mm, or 1.125 mm.

22. A MALDI sample plate as claimed in claim 1, wherein up to 48, 96, 384, 1536 or 6144 samples are arranged to be received on said sample plate.

23. A MALDI sample plate as claimed in claim 1, wherein samples are arranged to be deposited on said sample plate in a pattern of four samples about a central control sample well.

24. The combination of a MALDI sample plate and bio-molecules deposited on to said MALDI sample plate, wherein said MALDI sample plate comprises:

a substrate comprising a plurality of sample regions arranged in a microtitre format, wherein each sample region comprises:

a laser etched portion formed in said substrate, wherein said laser etched portion comprises originally hydrophobic material which has been subsequently polymerized by a laser;

a first portion surrounding at least part or substantially the whole of said laser etched portion;

a groove or raised portion surrounding at least part or substantially the whole of said first portion;

a first layer disposed on at least part or substantially the whole of said first portion, wherein said first layer comprises a first hydrophobic material selected from the group consisting of: (i) polytetrafluoroethylene ("PTFE"); and (ii) polystyrene; and a second layer disposed on at least a part or substantially the whole of said laser etched portion, wherein said second layer comprises a second hydrophobic material selected from the group consisting of: (i) polystyrene; and (ii) polytetrafluoroethylene ("PTFE").

25. A mass spectrometer in combination with a MALDI sample plate, said MALDI sample plate comprising:

a substrate comprising a plurality of sample regions arranged in a microtitre format, wherein each sample region comprises:

a laser etched portion formed in said substrate, wherein said laser etched portion comprises originally hydrophobic material which has been subsequently polymerized by a laser;

a first portion surrounding at least part or substantially the whole of said laser etched portion;

a groove or raised portion surrounding at least part or substantially the whole of said first portion;

a first layer disposed on at least part or substantially the whole of said first portion, wherein said first layer comprises a first hydrophobic material selected from the group consisting of: (i) polytetrafluoroethylene ("PTFE"); and (ii) polystyrene; and a second layer disposed on at least a part or substantially the whole of said laser etched portion, wherein said second layer comprises a second hydrophobic material selected from the group consisting of: (i) polystyrene; and (ii) polytetrafluoroethylene ("PTFE").

26. A method of making a MALDI sample plate, comprising the steps of:

providing a substrate comprising a plurality of sample regions arranged in a microtitre format, wherein each sample region comprises a portion to be laser etched and a first portion surrounding at least part or substantially the whole of said portion to be laser etched, and wherein a groove or raised portion surrounds at least part or substantially the whole of said first portion;

depositing a first layer on at least part or substantially the whole of said first portion, wherein said first layer comprises a first hydrophobic material selected from the group consisting of: (i) polytetrafluoroethylene ("PTFE"); and (ii) polystyrene;

laser etching the portions to be laser etched of each sample region thereby forming in each sample region a laser etched portion which comprises originally hydrophobic material which has been subsequently polymerized by a laser; and depositing a second layer on at least a part or substantially the whole of said laser etched portion, wherein said second layer comprises a second hydrophobic material selected from the group consisting of: (i) polystyrene; and (ii) polytetrafluoroethylene ("PTFE").

27. A method of mass spectrometry, comprising using a MALDI sample plate, said MALDI sample plate comprising:

a substrate comprising a plurality of sample regions arranged in a microtitre format, wherein each sample region comprises:

a laser etched portion formed in said substrate, wherein said laser etched portion comprises originally hydrophobic material which has been subsequently polymerized by a laser;

a first portion surrounding at least part or substantially the whole of said laser etched portion;

a groove or raised portion surrounding at least part or substantially the whole of said first portion;

a first layer disposed on at least part or substantially the whole of said first portion, wherein said first layer comprises a first hydrophobic material selected from the group consisting of: (i) polytetrafluoroethylene ("PTFE"); and (ii) polystyrene; and a second layer disposed on at least a part or substantially the whole of said laser etched portion, wherein said second layer comprises a second hydrophobic material selected from the group consisting of: (i) polystyrene; and (ii) polytetrafluoroethylene ("PTFE").

28. A method of sample preparation comprising the step of:

automatically or manually spotting or depositing samples on to a MALDI sample plate, said MALDI sample plate comprising:

a substrate comprising a plurality of sample regions arranged in a microtitre format, wherein each sample region comprises:

a laser etched portion formed in said substrate, wherein said laser etched portion comprises originally hydrophobic material which has been subsequently polymerized by a laser;

a first portion surrounding at least part or substantially the whole of said laser etched portion;

a groove or raised portion surrounding at least part or substantially the whole of said first portion;

a first layer disposed on at least part or substantially the whole of said first portion, wherein said first layer comprises a first hydrophobic material selected from the group consisting of: (i) polytetrafluoroethylene ("PTFE"); and (ii) polystyrene; and a second layer disposed on at least a part or substantially the whole of said laser etched portion, wherein said second layer comprises a second hydrophobic material selected from the group consisting of: (i) polystyrene; and (ii) polytetrafluoroethylene ("PTFE").

29. A method of sample preparation, comprising the step of:

automatically or manually washing samples deposited on to a MALDI sample plate, said MALDI sample plate comprising:

a substrate comprising a plurality of sample regions arranged in a microtitre format, wherein each sample region comprises:

a laser etched portion formed in said substrate, wherein said laser etched portion comprises originally hydrophobic material which has been subsequently polymerized by a laser;

a first portion surrounding at least part or substantially the whole of said laser etched portion;

a groove or raised portion surrounding at least part or substantially the whole of said first portion;

a first layer disposed on at least part or substantially the whole of said first portion, wherein said first layer comprises a first hydrophobic material selected from the group consisting of: (i) polytetrafluoroethylene ("PTFE"); and (ii) polystyrene; and a second layer disposed on at least a part or substantially the whole of said laser etched portion, wherein said second layer comprises a second hydrophobic material selected from the group consisting of: (i) polystyrene; and (ii) polytetrafluoroethylene ("PTFE").

30. A method of mass spectrometry, comprising the step of:

automatically or manually analysing analyte deposited on to a MALDI sample plate, said MALDI sample plate comprising:

a substrate comprising a plurality of sample regions arranged in a microtitre format, wherein each sample region comprises:

a laser etched portion formed in said substrate, wherein said laser etched portion comprises originally hydrophobic material which has been subsequently polymerized by a laser;

a first portion surrounding at least part or substantially the whole of said laser etched portion;

a groove or raised portion surrounding at least part or substantially the whole of said first portion;

a first layer disposed on at least part or substantially the whole of said first portion, wherein said first layer comprises a first hydrophobic material selected from the group consisting of: (i) polytetrafluoroethylene ("PTFE"); and (ii) polystyrene; and a second layer disposed on at least a part or substantially the whole of said laser etched portion, wherein said second layer comprises a second hydrophobic material selected from the group consisting of: (i) polystyrene; and (ii) polytetrafluoroethylene ("PTFE").

31. A method of sample preparation, comprising the step of:

automatically or manually chemically destaining gel or membrane samples in situ on a MALDI sample plate, said MALDI sample plate comprising:

a substrate comprising a plurality of sample regions arranged in a microtitre format, wherein each sample region comprises:

a laser etched portion formed in said substrate, wherein said laser etched portion comprises originally hydrophobic material which has been subsequently polymerized by a laser;

a first portion surrounding at least part or substantially the whole of said laser etched portion;

a groove or raised portion surrounding at least part or substantially the whole of said first portion;

a first layer disposed on at least part or substantially the whole of said first portion, wherein said first layer comprises a first hydrophobic material selected from the group consisting of: (i) polytetrafluoroethylene ("PTFE"); and (ii) polystyrene; and a second layer disposed on at least a part or substantially the whole of said laser etched portion, wherein said second layer comprises a second hydrophobic material selected from the group consisting of: (i) polystyrene; and (ii) polytetrafluoroethylene ("PTFE").

32. A method of sample preparation, comprising the step of:

automatically or manually chemically reducing samples in situ on a MALDI sample plate, said MALDI sample plate comprising:

a substrate comprising a plurality of sample regions arranged in a microtitre format, wherein each sample region comprises:

a laser etched portion formed in said substrate, wherein said laser etched portion comprises originally hydrophobic material which has been subsequently polymerized by a laser;

a first portion surrounding at least part or substantially the whole of said laser etched portion;

a groove or raised portion surrounding at least part or substantially the whole of said first portion;

a first layer disposed on at least part or substantially the whole of said first portion, wherein said first layer comprises a first hydrophobic material selected from the group consisting of: (i) polytetrafluoroethylene ("PTFE"); and (ii) polystyrene; and a second layer disposed on at least a part or substantially the whole of said laser etched portion, wherein said second layer comprises a second hydrophobic material selected from the group consisting of: (i) polystyrene; and (ii) polytetrafluoroethylene ("PTFE").

33. A method of sample preparation, comprising the step of:

automatically or manually chemically alkylating samples in situ deposited on to a MALDI sample plate, said MALDI sample plate comprising:

a substrate comprising a plurality of sample regions arranged in a microtitre format, wherein each sample region comprises:

a laser etched portion formed in said substrate, wherein said laser etched portion comprises originally hydrophobic material which has been subsequently polymerized by a laser;

a first portion surrounding at least part or substantially the whole of said laser etched portion;

a groove or raised portion surrounding at least part or substantially the whole of said first portion;

a first layer disposed on at least part or substantially the whole of said first portion, wherein said first layer comprises a first hydrophobic material selected from the group consisting of: (i) polytetrafluoroethylene ("PTFE"); and (ii) polystyrene; and a second layer disposed on at least a part or substantially the whole of said laser etched portion, wherein said second layer comprises a second hydrophobic material selected from the group consisting of: (i) polystyrene; and (ii) polytetrafluoroethylene ("PTFE").

34. A method of sample preparation, comprising the step of:

automatically or manually tryptically or chemically digesting samples in situ on a MALDI sample plate, said MALDI sample plate comprising:

a substrate comprising a plurality of sample regions arranged in a microtitre format, wherein each sample region comprises:

a laser etched portion formed in said substrate, wherein said laser etched portion comprises originally hydrophobic material which has been subsequently polymerized by a laser;

a first portion surrounding at least part or substantially the whole of said laser etched portion;

a groove or raised portion surrounding at least part or substantially the whole of said first portion;

a first layer disposed on at least part or substantially the whole of said first portion, wherein said first layer comprises a first hydrophobic material selected from the group consisting of: (i) polytetrafluoroethylene ("PTFE"); and (ii) polystyrene; and a second layer disposed on at least a part or substantially the whole of said laser etched portion, wherein said second layer comprises a second hydrophobic material selected from the group consisting of: (i) polystyrene; and (ii) polytetrafluoroethylene ("PTFE").

35. A method of sample preparation, comprising the step of:

automatically or manually chemically derivatising samples deposited in situ on a MALDI sample plate, said MALDI sample plate comprising:

a substrate comprising a plurality of sample regions arranged in a microtitre format, wherein each sample region comprises:

a laser etched portion formed in said substrate, wherein said laser etched portion comprises originally hydrophobic material which has been subsequently polymerized by a laser;

a first portion surrounding at least part or substantially the whole of said laser etched portion;

a groove or raised portion surrounding at least part or substantially the whole of said first portion;

a first layer disposed on at least part or substantially the whole of said first portion, wherein said first layer comprises a first hydrophobic material selected from the group consisting of: (i) polytetrafluoroethylene ("PTFE"); and (ii) polystyrene; and a second layer disposed on at least a part or substantially the whole of said laser etched portion, wherein said second layer comprises a second hydrophobic material selected from the group consisting of: (i) polystyrene; and (ii) polytetrafluoroethylene ("PTFE").

* * * * *